US007901733B2

(12) United States Patent
Klutz et al.

(10) Patent No.: US 7,901,733 B2
(45) Date of Patent: Mar. 8, 2011

(54) METHOD OF MAKING DUAL FUNCTION FABRICS

(75) Inventors: David S. Klutz, Shelby, NC (US); William C. Kimbrell, Spartanburg, SC (US); Dale R. Williams, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 8 days.

(21) Appl. No.: 12/381,726

(22) Filed: Mar. 16, 2009

(65) Prior Publication Data

US 2009/0178205 A1 Jul. 16, 2009

Related U.S. Application Data

(62) Division of application No. 10/780,976, filed on Feb. 18, 2004, now Pat. No. 7,517,819.

(51) Int. Cl.

| | |
|---|---|
| ***B05D 5/00*** | (2006.01) |
| ***B05D 7/24*** | (2006.01) |
| ***B05D 1/36*** | (2006.01) |
| *B32B 27/04* | (2006.01) |

(52) U.S. Cl. ..... 427/209; 427/412

(58) Field of Classification Search ..... 427/209, 427/412; 442/59, 79, 82, 83, 86, 88; 8/155.51, 8/155.54, 445, 478

See application file for complete search history.

(56) References Cited

U.S. PATENT DOCUMENTS

| | | | | |
|---|---|---|---|---|
| 1,900,904 | A * | 3/1933 | Berger | 442/85 |
| 2,650,170 | A * | 8/1953 | Kimball | 428/172 |
| 3,326,713 | A | 6/1967 | Smith et al. | 117/76 |
| 3,634,126 | A | 1/1972 | Cain et al. | 427/176 |
| 3,649,344 | A | 3/1972 | Crabtree et al. | 177/135.5 |
| 3,852,090 | A | 12/1974 | Leonard et al. | 117/14 |
| 4,355,065 | A | 10/1982 | DeMott | 428/195 |
| 4,610,915 | A | 9/1986 | Crenshaw | 428/219 |
| 5,209,965 | A | 5/1993 | Caldwell | 428/260 |
| 5,418,051 | A | 5/1995 | Caldwell | 428/240 |
| 5,747,392 | A | 5/1998 | Xiao et al. | 442/82 |
| 5,753,568 | A | 5/1998 | Shimano et al. | 442/64 |
| 5,792,404 | A | 8/1998 | Cree et al. | 264/134 |
| 5,853,861 | A | 12/1998 | Held | 428/207 |
| 5,891,812 | A | 4/1999 | Honeycutt et al. | 442/118 |
| 5,932,316 | A | 8/1999 | Cree et al. | 428/182 |
| 6,129,978 | A | 10/2000 | Caldwell | 428/213 |
| 6,187,391 | B1 | 2/2001 | Kataoka et al. | 427/569 |
| 2002/0132541 | A1 | 9/2002 | Vogt et al. | 442/64 |
| 2003/0045193 | A1 | 3/2003 | Snowden et al. | 442/110 |
| 2003/0077963 | A1 | 4/2003 | Cates et al. | 442/118 |
| 2003/0082968 | A1 | 5/2003 | Sharma et al. | 442/59 |
| 2003/0100234 | A1 | 5/2003 | Waeber et al. | 442/85 |
| 2004/0037963 | A1 | 2/2004 | Hubner et al. | 427/385.5 |
| 2004/0137814 | A1 | 7/2004 | Kimbrell et al. | 442/93 |
| 2005/0000028 | A1 | 1/2005 | Baker et al. | 8/142 |
| 2005/0186873 | A1 | 8/2005 | Wang et al. | 442/88 |

FOREIGN PATENT DOCUMENTS

| | | |
|---|---|---|
| EP | 0 693 587 | 1/1995 |
| WO | 02075038 | 9/2002 |
| WO | 02079563 | 10/2002 |
| WO | 02084013 | 10/2002 |
| WO | 02084016 | 10/2002 |
| WO | 03044263 | 5/2003 |

* cited by examiner

*Primary Examiner* — William Phillip Fletcher, III
(74) *Attorney, Agent, or Firm* — Cheryl J. Brickey

(57) ABSTRACT

A method of making fabrics having first and second surfaces that exhibit different performance characteristics by virtue of having been treated with different chemical treatments is described. In addition, fabrics having first and second surfaces that exhibit different performance characteristics, such as one surface exhibiting oil and water repellency and optionally, soil release characteristics, and the opposite surface exhibits moisture transport characteristics.

10 Claims, 1 Drawing Sheet

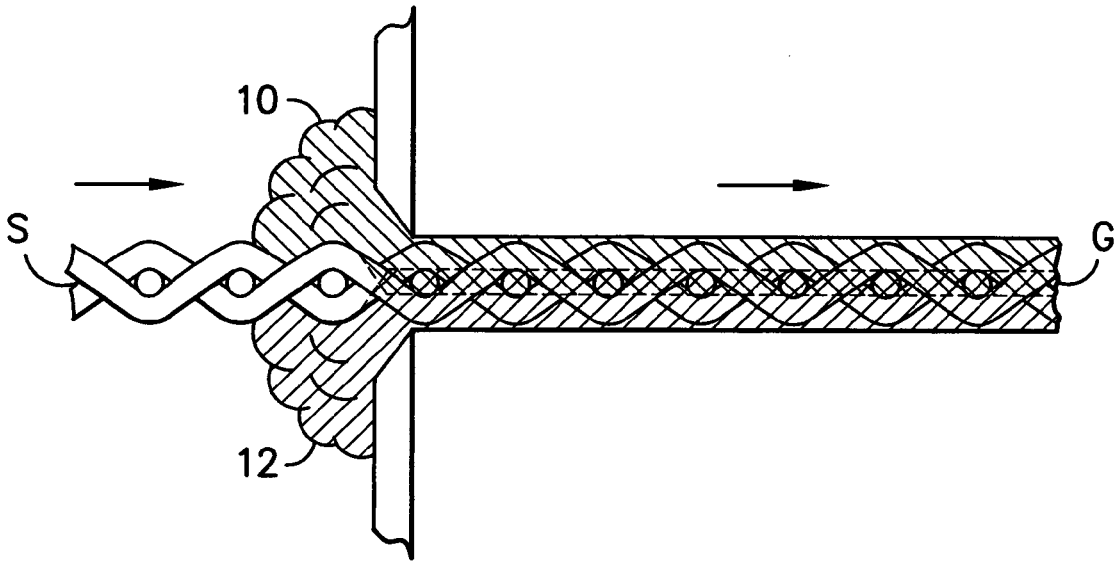
*FIG. –1–*

METHOD OF MAKING DUAL FUNCTION FABRICS

CROSS-REFERENCE TO RELATED APPLICATIONS

This application is a divisional of U.S. application Ser. No. 10/780,976 filed on Feb. 18, 2004, now U.S. Pat. No. 7,517,819, the contents of which are incorporated by reference herein in their entirety.

BACKGROUND OF THE INVENTION

Textile fabrics are widely utilized in a variety of applications, including such things as apparel, home furnishings, automobiles, etc. In many applications, it is desired to enhance fabric performance through a treatment process, such as by chemically treating the fabric, mechanically treating it, or forming it into a composite. Chemical treatments perform well in many instances. However, the treatments typically result in fabrics where both surfaces have approximately the same performance characteristics. For example, a soil release finish applied to an apparel-weight fabric typically provides soil release capability to both fabric surfaces.

In some instances, it may be desirable to have a fabric where each of the fabric surfaces performs in a different manner. Conventional methods of achieving such a structure are by forming a layered type fabric or composite, or by applying a chemical treatment or coating to one side of a fabric, which is typically a relatively thick coating.

For example, European patent 0546580B1 describes a printing process for treating one side only of a hydrophobic nonwoven fabric with a wetting agent to produce a two-sided fabric with hydrophilic and hydrophobic properties. In this material, the hydrophobicity is only that which the nonwoven substrate inherently possesses, and is therefore only limitedly hydrophobic. In addition the hydrophilic properties exhibit rather limited durability to laundering because the wetting agent is removed.

SUMMARY

The instant invention provides a method for achieving fabrics having different performance characteristics on each fabric surface. More specifically, the method enables the achievement of fabrics having each of the fabric surfaces modified by a different chemical treatment. For example, in some instances, both surfaces are treated to enhance the durable hydrophilicity of one surface and the durable hydrophobicity of the opposing surface. In another embodiment of the instant invention, in addition to providing an enhanced durable hydrophilic and opposing enhanced durable hydrophobic surface, the instant invention is practiced utilizing chemistry that enhances the stain release properties of the entire fabric. In addition, the fabrics can utilize chemical treatments on the respective fabric surfaces that would generally form an insoluble complex (i.e. coagulate or precipitates) if provided together.

For example, in one embodiment of the invention, a fabric is achieved that has durable water and oil repellency on one side and moisture transport (i.e. wicking) capability on the other side. In this embodiment, both the repellency and the moisture transport properties are greater than those of the untreated substrate itself. In other words, the characteristics are achieved or at a minimum, enhanced, by the use of a chemical treatment on each of the fabric sides.

The method of the invention involves providing two chemical treatments that are otherwise considered to be incompatible, and applying one of the chemical treatments on a first surface of a fabric substrate and another on the second (i.e. the opposite) surface of the fabric. For purposes of this application, the term "incompatible" chemical treatments describes treatments that turn cloudy and/or precipitate within one minute when a 10% solution of each chemical treatment is mixed together. Particularly preferred for purposes of the invention are those chemical treatments that are highly incompatible, that is, when 10% solutions of each chemical treatment are mixed together, the mixture turns cloudy and/or precipitates substantially instantaneously.

In one embodiment of the instant invention, the process involves treating one side of a textile substrate with a cationic chemical treatment and the other surface with an anionic chemical treatment. Preferably, the chemical applications are performed substantially simultaneously or closely together, or at a minimum, where both are in a wet condition (i.e. as a wet on wet process.) In some embodiments of the invention, the chemical component designed to achieve the specific desired performance will be selected to have inherent cationic or anionic characteristics, while in others supplemental chemistries will be included in the chemical treatment to enhance the cationic or anionic nature of the active functional component. As will be appreciated by those of ordinary skill in the art, it would be expected that thinner substrates will employ more concentrated chemical treatments than thicker substrates.

In other embodiments of the invention, other combinations of incompatible chemistries can be used, such as a strongly anionic treatment in combination with a multivalent metal ion, or a cationic fluorochemical in combination with a nonionic wicking chemistry with basic chemistry (which destroys the emulsifying chemistry of the cationic fluorochemical.)

BRIEF DESCRIPTION OF THE DRAWINGS

FIG. 1 is a schematic representation of a theory of how the method of the invention functions.

DETAILED DESCRIPTION

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

It has been discovered by the inventors that by utilizing incompatible chemical treatments and applying them in a wet-on-wet state, treatments which might normally interfere with each other can be applied to the substrates to achieve different functionalities on each substrate surface. In other words, chemistries can be used on the respective surfaces that would otherwise form an insoluble complex if mixed together in a single bath or otherwise applied together. For example, in one embodiment of the invention, a repellent chemistry is applied to one surface of the fabric and a moisture wicking chemistry is applied to the other surface. Typically, these chemistries could not be provided as a single treatment, since they would interfere with each other.

In that embodiment of the invention, the repellent chemistry desirably not only repels both moisture and oil, but it also is designed to release soils. The fabrics made in this manner can be used to produce, for example, garments having improved performance, since they provide repellency while enabling the evaporation of moisture from the wearer's skin out through the fabric. In other words, this dual function enables moisture on the inside of the garment to be spread out and evaporated through the fabric surface. This enables a fabric that exhibits water and stain resistance and enhanced wearer comfort.

In one aspect of the invention, it has been found that while it is indeed possible to produce textiles that have opposite performance properties on each surface utilizing oppositely charged chemistries, there are chemistries and downstream processes that tend to adversely affect the performance achieved. Such has been found if certain fluorochemicals are used on cellulosic containing fabrics that are subsequently post-cured with resins to provide for instance, durable creases. The extended exposure time to elevated temperatures results in a significant decrease in the hydrophilic properties that existed before the resin curing process. Without wishing to be bound by theory, the inventors believe that certain fluoropolymers tend to melt and flow at the resin curing conditions and therefore transfer to the opposite surface, resulting in the observed decrease in hydrophilic properties.

However, it has been discovered that certain fluorosurfactants can be applied with the hydrophilic chemistry to alleviate this adverse effect. Without being bound by theory, it is believed that such fluorosurfactants can enhance the hydrophilic properties while simultaneously providing an oleophobic property that effectively blocks the transfer of the molten fluoropolymer. Indeed, evidence of the proposed mechanisms has been provided by XPS analysis of the two fabric surfaces after heat treatment. Without the fluorosurfactant, the amount of fluorine on the hydrophilic surface increases after a resin curing process. Incorporation of the fluorosurfactant or utilizing fluoropolymers with higher melt flow characteristics has been found to reduce the amount of fluorine on the hydrophilic surface after the resin curing process.

With the development of XPS, SIMS, and other surface analytical techniques, it has become possible to detect certain chemical groups at the surface of materials. For instance, one can measure the concentration and depth profile of functional groups, such as $CF_3$ moieties commonly found in fluoropolymer stain resist chemicals.

Since the first use of XPS to probe polymer surfaces, as described in *The Journal of Polymer Science and Polymer Chemistry Ed.* (1977, vol. 15, p. 2843) by D. T. Clark and H. R. Thomas, it has become a standard, quantitative tool for their characterization. The energy-analyzed electrons, photoemitted during irradiation of a solid sample by monochromatic X-rays, exhibit sharp peaks which correspond to the binding energies of core-level electrons in the sample. The peaks of these binding energies can be used to identify the chemical constituents in the specimen.

The mean free path of electrons in solids is very short ($\lambda$~2.3 nm). For reference, see *Macromolecules* (1988, vol. 21, p. 2166) by W. S. Bhatia, D. H. Pan, and J. T. Koberstein. The effective sampling depth, Z, of XPS can be calculated by $Z=3\lambda \cos \theta$, where $\theta$ is the angle between the surface normal and the emitted electron path to the analyzer. So the maximum depth that can be probed is about 7 nm at $\theta=0$. For typical atomic components of polymers, C, N, and O, optimized XPS can detect compositions of 0.2 atom percent. XPS is also very sensitive to F and Si. Such quantitative information is very useful in understanding polymer surface behaviors.

X-ray photoelectron spectroscopy (XPS) was employed here to examine the chemical composition of the modified textile surfaces and, furthermore, to evaluate the surface chemical composition change under different environmental situations. XPS spectra were obtained using a Perkin-Elmer Model 5400 XPS spectrometer with a Mg □□X-ray source (1253.6 eV), operated at 300 W and 14 kV DC, with an emission current of 25 mA. The spot size was 1.0×3.0 mm. Photoelectrons were analyzed in a hemispherical analyzer using a position-sensitive detector.

The table below lists the % fluorine obtained by XPS analysis of the surface of various treated fabrics. In each case, the fluorochemical was foamed onto the face of the fabric and subsequently dried. The % fluorine was measured on the face and back of the fabric. Following drying, a portion of the fabric was cured under conditions required for the permanent press resin and % fluorine on the back of the fabric was measured.

XPS 1 contains Zonyl 7713, believed to be a urethane based fluoropolymer manufactured by DuPont. As can be seen in the Table, a significant amount of this fluoropolymer is transferred to the back of the fabric during the drying step. The resin curing conditions results in further migration of the fluoroploymer.

XPS 2 contains Repearl F-8025, believed to be an acrylate based polymer distributed by Mitsubishi International. Significantly less fluoropolymer migrates to the back of the fabric during drying or subsequent curing of the product. Without being bound by theory, we believe this is due to the higher melt/flow characteristic of this fluoropolymer.

XPS 3 contains fluoropolymers, including Zonyl 7713, and resins foamed onto the face of the fabric and anionic stain release polymers foamed onto the back of the fabric. As can be seen in the Table, the fluorine on the back of the fabric is greatly reduced by this combination. This indicates that the combination of cationic fluorochemical and anionic stain release polymer does indeed limit the penetration of the components. While not statistically significant, the % fluorine after curing appears to increase slightly and corresponds with a decreased moisture wicking time on the back of the fabric after curing.

XPS 4 is a repeat of XPS 3, except a fluorosurfactant was added to the stain release mix applied to the back of the fabric. This formulation also limits the penetration of fluoropolymer to the back of the fabric. Additionally, while again not statistically significant, it appears that the addition of the fluorosurfactant appears to eliminate further transfer of the fluoropolymer to the back of the fabric during the cure of the resin.

The fabric utilized to perform the XPS Analysis was a 8 $o^2$/sq $y^2$d. 3×1 left hand twill made from 65/35 polyester/cotton single ply open end spun yarns. As described later in this patent as Example B.

The chemical compositions applied to the XPS Analysis samples XPS 1-4 were applied. Utilizes a parabolic foamer supplied by Gaston systems as a wet pick up of 10% on the face and 10% on the Back in the following concentrations:

The fabric was then dried at 300° F.

XPS 1

Face—7% Zonyl 7713 (FLuoroacrylate emulsion manufactured by Dupont de Nemours). 8% Arkohob Dan (urethane dispersion from Clariant). 40% Permafresh MFX (DMD HEU resin supplied by Omnova Solutions). 10% Catalyst 531 (magnesium chloride supplied by Omnova Solutions). 3% Mykon NRW3 (Amide Oxide surfactant supplied by Omnova Solutions).

Back—Untreated.

XPS 2

Face—7% Repearl F8025 (Fluoroacrylate copolymer emulsion from MCI Specialty Chemicals). 40% Permafresh MFX. 10% Catalyst 531.3% Mykon NRW3.

Back—Untreated

XPS 3

Face—21.6% Unidyne TG99 (Fluoroalkyl Acrylate copolymer supplied by Daiken Chemical). 7% Zonyl 7713.8% Arkophob DAN. 40% Permafresh MFX. 10% Catalyst 531.3% Mykon NRW3.

Back—30% Acrylic copolymer (composed of 65% methacrylic acid and 35% ethyl acrylate). 3% Mykon NRW3. 2.5% SCT 310 (Sodium laurel sulfate supplied by Southern Chemical and Textiles).

XPS 4

Face—Same as XPS3.

Back—30% Acrylic copolymer. 0.75% Zonyl FSP (anionic Fluorosurfactant supplied by Dupont de Nemours). 3% Mykon NRW3. 2.5% SCT 610.

Table-Surface Chemical Analysis of poly cotton fabric to identify blocking mechanism.

Example XPS Test Results Surface Chemical Analysis

| Test | XPS1 | XPS2 | XPS3 | XPS4 |
|---|---|---|---|---|
| Air Heat (300° F.) as received Face | 41.8 | 41.53 | 49.32 | 52.23 |
| Air Heat (300° F.) as received Back | 18.91 | 4.58 | 6.88 | 13.18 |
| Resin Core-Back (310° F., 10 min.) | 26.7 | 5.18 | 8.37 | 13.00 |
| % increase in Flourine on Back after Core | 41.20 | 13.0% | 21.65 | −0.01 |

In another aspect of the invention, in some embodiments, it has been found to be advantageous to treat the substrate with a soil release fluorochemistry prior to application of the chemical treatments, particularly where the substrate is a hydrophobic substrate that is being batch dyed (e.g. a jet dyed 100% polyester fabric.) It has been surprisingly found that a pretreatment with this chemistry facilitates retention of the chemistries on the respective surfaces to which they were applied, particularly when used in combination with a cationic fluorochemical repellent and an anionic wicking surfactant.

The method of the invention can be performed as follows. A substrate is provided, which can be of any conventional variety, such as a woven, knit, or nonwoven fabric. Within those classes of fabrics, it can be of any variety (e.g. warp or weft knit, woven in any conventional construction such as plain weave, jacquard, satin, twill woven, fleece, etc.) While the method can utilize virtually any weight and thickness of substrate, it is particularly advantageous when utilized with mid to lightweight substrates (e.g. about 3 to about 10 oz/sq yard.) In fact, the invention has been found to work particularly well in combination with lightweight fabrics. In addition, it can be used with substrates that are relatively thin (e.g. about 5 mils to about 70 mils, and more preferable about 10 mils to about 20 mils when measured according to ASTM D1777-2002 Test Method, with a mil equaling one thousandth of an inch.)

The fabric can be made from fibers of any size, such as microdenier or larger fibers, spun or filament yarns or combinations thereof, and can be made from single or multi-ply yarns. The fabric can be made from any fiber, such as polyester, cotton, nylon, PLA, regenerated cellulose, spandex, wool, silk, polyolefins, polyaramids, polyurethanes, or blends thereof.

Preferably, the substrate is prepared in a conventional manner. (As will be readily appreciated by those of ordinary skill in the art, fabric preparation typically involves washing the fabric to remove any size, lubricants, etc. that may be present on the substrate from the fabric formation process.)

The substrate then can optionally be face finished in a conventional manner on one or both substrate surfaces. For example, in an embodiment of the invention described below where a repellent/soil release chemistry is applied to the fabric face and a wicking chemistry is applied to the fabric back, the face of the fabric was desirably sanded to enhance its aesthetic characteristics (since it will form the outer surface of a garment), and the fabric back was also sanded. It was surprisingly found that by sanding the back of the fabric in this embodiment, the wicking performance of the fabric was improved over samples which were manufactured in the same manner, but not sanded on the back. However, fabrics that have neither surface, only one surface, or both surfaces face finished (e.g. sanded) are all contemplated within the scope of the invention.

The substrate can also be dyed or otherwise colored, if desired, in any conventional manner at any point in the process. Alternatively, the fabric can be made from solution dyed fibers or previously dyed fibers, or left undyed. For example, the fabric can be jet dyed, range dyed, printed, prepared for printing, etc.

In some embodiments of the invention such as fabrics made from hydrophobic fibers that are to be batch dyed, the substrate is desirably treated overall with a small amount (e.g. about 0.25% to about 2% on weight of fabric "owf", and preferably, about 1% owf) of soil release chemistry prior to the chemical treatment application. The soil release chemistry is desirably a fluorochemical designed to facilitate soil release. It was surprisingly found by the inventors that by applying a pretreatment of a soil release chemistry such as a soil release fluorochemical, migration of the chemical treatments was reduced. Where the fabric is jet dyed, the soil release chemistry can be included in the dye jet.

The substrate is then treated with a first chemical treatment on a first surface, and a second chemical treatment on the second fabric surface, with the first and second chemical treatments being selected to provide the respective fabric surfaces with different performance characteristics. (If the fabric was dyed prior to this step, then it is desirably dried prior to the chemical treatment process.) In order to prevent the two chemical treatments from migrating too far into the fabric and interfering with each other, the chemical treatments are desirably selected to be incompatible with each other. For example, one may be cationic and the other anionic, one may be strongly anionic while the other is a multivalent metal ion, or one is may be a cationic fluorochemical while the other is a nonionic wicking chemical with basic chemistry.

This can be visualized as a three-layer sandwich such as that illustrated in FIG. 1. As illustrated, the substrate S has a first chemical treatment 10 on its first surface, and a second chemical treatment 12 on its opposite surface. It is believed by the inventors that where the first chemical treatment 10 and second chemical treatment 12 meet in the center of the substrate, a gel or other type of semi-solid layer G is formed, which facilitates retention of the respective chemical treatments on the surface to which they were applied. In addition, it is believed that where a cationic chemical treatment is applied to one surface and an anionic chemical treatment is applied to the opposite surface, the opposite charge of the respective chemistries enables them to repel each other to an extent sufficient to retain them on their respective surfaces.

In support of this theory, the inventors performed the following experiment:

A 2×2 left hand twill 100% polyester fabric having a 1/150/176 filament warp and a 2/140/2000 100% polyester filling. A mixture of 5% Kymene 450, 21.6% Unidyne TG992, 7% Repearl F8025, 8% Arko Phob Dan, 3% Mykon NRW3 and 5% blue color basic dye was applied to the fabric face at 10% wpu using a dual sided foamer of the variety marketed by Gaston Systems, and a mixture of 7.5% SCT610, 4.5% Mykon NRW3, 1.1% Zonyl FSP, 30% acrylic copolymer which is 65% methacrylic acid and 35% ethyl acrylate, 3.75% Arko Phob Dan and 5% red acid dye was applied at 10% wpu to the fabric back substantially simultaneously. The fabric was then dried at 325° F. for 2 minutes.

When observed under a microscope, the resulting fabrics had a red surface corresponding to the side with the acid dye, a blue surface where the chemistry including the basic dye was applied, and a center region that had a purple color, corresponding to where the inventors believe the gel layer is formed.

The chemical treatments are desirably provided to the substrate in a manner designed to locate the chemistry on a single fabric surface (as opposed to padding the chemistry onto the entire fabric), such as by foaming the chemistry onto the substrate, spraying, kiss coating, gravure roller coating, printing, or the like, or a combination thereof. In a preferred form of the invention, the chemistries are applied to the fabric substantially simultaneously. For example, a dual sided foamer of the variety commercially available from Gaston Systems of Stanley, N.C. can be used to apply both chemistries substantially simultaneously, since the application heads are located approximately four inches apart on the apparatus. In any event, it is desirable that both chemistries be wet at the same time, so a single application process is preferred. It is believed that the presence of the moisture from the two wet applications facilitates the retention of the chemical treatments on their respective surfaces, and where the cationic/anionic mechanism is used, the wet on wet application is believed to facilitate repulsion of the chemistries due to their opposite charges.

One preferred form of the invention is designed to achieve oil and water repellency and soil release on one fabric surface and moisture wicking on the opposite surface. In that case, the fabric is desirably treated on one surface with a cationic fluorochemical repellent which is a fluoroacrylate or which has a polyurethane backbone, and the other surface of the fabric is treated with an anionic wicking polymer. In a preferred form of the invention, the wicking chemistry is a combination of ingredients including a wickable (hydrophilic) acrylic polymer and a fluorosurfactant. Also in a preferred form of the invention, the chemical treatments are applied while both are wet (i.e. using a wet-on-wet application process), and even more preferably, they are applied substantially simultaneously.

It is noted that in addition to the two chemical treatments' primary functionality, they can contain additional chemistries designed to provide additional performance features, such as odor control, static reduction, antimicrobial properties, improved fabric handle, durable press performance, etc. Also, where the chemical treatment is an oil and/or water repellent, it also desirably has a soil release function as well. Examples of chemistries designed to provide this combination of features are described in commonly-assigned U.S. patent application Ser. No. 10/339,840 to Kimbrell et al filed Jan. 10, 2003, Ser. No. 10/339,971 to Fang et al filed Jan. 10, 2003, Ser. No. 10/339,911 to Kimbrell et al filed Jan. 10, 2003, and Ser. No. 10/340,300 to Kimbrell et al filed Jan. 10, 2003, the disclosures of which are all hereby incorporated herein by reference.

Test Methods

Water Repellency—Water repellency was tested using the following method:

Using the 6 test reagents listed in Table 1 below rate the water repellency of textile fabrics as follows:

1. Allow test specimens to condition for 4 hours at standard temperature and relative humidity before testing.
2. Place the test specimen on a flat black top surface such as a table.
3. Starting with the lowest numbered reagent place 5 drops across the width of the fabric no closer than 1 inch between drops and count the time it takes for the reagent to wet into the fabric using a stopwatch or similar timing device.
4. The 5 drops are place onto the test specimen not dropped from a height using an eye dropper. Each drop should be no larger than ¼ inch in diameter.
5. If the time is greater than 10 seconds repeat step 3 with the next highest reagent.
6. Continue repeating steps 3 and 4 until a reagent wets the test specimen in less than 10 seconds.
7. The repellency rating is the highest numbered reagent that does not wet the test specimen in 10 seconds. For example if reagent 4 takes longer than 10 seconds to wet the test specimen but reagent 5 takes only 7 seconds to wet the test specimen then the test specimen has a water repellency rating of 4.

TABLE 1

Water Repellency Test Reagents

| Water Repellency Rating Number | % Isopropanol CAS NO. 67-63-0 | % Water CAS NO. 7732-18-5 |
|---|---|---|
| 1 | 2 | 98 |
| 2 | 5 | 95 |
| 3 | 10 | 90 |
| 4 | 20 | 80 |
| 5 | 30 | 70 |
| 6 | 40 | 60 |

Percentages are by volume and reagent grade isopropanol must be used.

Oil Repellency—Oil repellency was measured according to AATCC Test Method 118-2002, in its as received "AR" condition, after 5 washes, 10 washes, 20 washes and 30 washes (5W, 10W, 20W, and 30W, respectively). All washes were performed according to the wash procedure described below. The fabrics were rated between 0 and 6, with a higher number indicating that a fabric has greater oil repellency.

Stain Release—Stain release was tested for corn oil and mineral oil according to AATCC Test Method 130-1995. The fabrics were stained at the first number in the numbered pairing listed in the results table, then stain release was rated after the second number in the pairing (e.g. 4/5 indicates the fabric was stained after 4 washes, then rated after the $5^{th}$ washing.) All washings were performed according to the wash procedure described below.

Drop Wicking—prop wicking was tested according to AATCC Test Method 79-1995 "Absorbency of Bleached Textiles", as received ("A/R"), and after the number of washes (W) indicated.

Wash Procedure—Where washings were indicated for oil repellency, water repellency, and wicking, they were performed according to AATCC Test Method 124-2001 "Appearance of Fabrics After Repeated Home Laundering." For soil release, they were washed according to MTCC Test Method 130-2000 "Soil Release: Oily Stain Release Method."

Fabric Thickness—Fabric thickness was tested according to ASTM D1777 Standard Test Method for Thickness of Textile Materials (2002.)

Air Permeability—Air permeability was tested according to ASTM D737-96" Test Method for Air Permeability of Textile Fabrics".

Water Vapor Transmission—Water vapor transmission was tested according to ASTM E96-00el "Test Method for Water Vapor Transmission of Materials" (2000).

EXAMPLES (Note: where sanding was performed, it was performed on a Mueller sanding machine in a conventional manner. In addition, all chemistry applications were performed using a CFS dual sided foam applicator of the variety commercially available from Gaston Systems of Stanley, N.C. in a conventional manner, with the chemical treatments applied as described below.) Samples were dried in a oven at 300° F. for two (2) minutes.

Example A

All of the Example A fabrics were a 6.0-6.50 oz./sq. yd. 2×2 right hand twill fabrics with a 1/150/176 warp yarn and a 2/140/200 filling yarn.

Example A1

The fabric face was treated with a mixture including 8.30% fluoroacrylate copolymer emulsion (Repearl F8025 from MCI Specialty Chemicals), 25% soil release fluorochemical (Fluoroalkyl acrylate copolymer—Unidyne TG992 from Daiken Chemical), 8.60% Urethane dispersion (Arko Phob Dan from Clariant), 12.00% Cellulosic thickener (Hipochem MFS available from Bohme Filatex), and 3.00% Methyl alcohol surfactant (Hipochem EMS available from Bohme Filatex), applied at 10.00% wet pick up (wpu.)

The fabric back was treated with a mixture including 5.00% sodium laurel sulfate surfactant (SCT610 available from Southern Chemical and Textiles), 20.00% Acrylic copolymer made from 65% methacrylic acid and 35% ethyl acrylate, 2.50% Urethane dispersion (Arko Phob Dan from Clariant), 0.75% Repearl FS112 available from MCI Specialty Chemicals, 3.00% Amide oxide surfactant (Mykon NRW3 available from Omnova Solutions Inc.), applied at 10.00% wpu.

Example A2

Both the fabric face and back were sanded.

In this example, 0.5% fluorochemical (FC258 available from 3M) owf was added during the dye process.

Face—8.30% fluorochemical repellent (Fluoroacrylate copolymer emulsion (Repearl F8025 from MCI Specialty Chemicals), 25.00% soil release fluorochemical (Fluoroalkyl acrylate copolymer (Unidyne TG992 from Daiken Chemical)), 8.60% Urethane dispersion (Arko Phob Dan from Clariant), 12.00% Cellulosic thickener (Hipochem MFS available from Bohme Filatex), Amide oxide surfactant (Mykon NRW3 available from Omnova Solutions Inc.), were applied at 10.00% wpu.

Back—7.50% sodium laurel sulfate surfactant (SCT610 available from Southern Chemical and Textiles), 20.00% Acrylic copolymer composed of 65% methacrylic acid and 35% ethyl acrylate, 2.50% Urethane dispersion (Arko Phob Dan from Clariant), 0.75% Repearl FS112 available from MCI Specialty Chemicals, 3.00% Amide oxide surfactant (Mykon NRW3 available from Omnova Solutions Inc.) were applied at 10.00% wpu.

Example A3

Both the face and the back were sanded.

0.5% fluorochemical (FC258 available from 3M) owf was added in jet dyeing. The face was treated with a mixture of 8.30% fluorochemical repellent (Repearl F8025 available from MCA Specialty Chemicals), 25.00% soil release fluorochemical (Unidyne TG992 available from Daiken Chemical), 8.60% Urethane dispersion (Arko Phob Dan from Clariant), 5.00% Ionic booster Kymene 450 from Hercules Chemicals, and 3.00% Amide oxide surfactant (Mykon NRW3 from Omnova Solutions Inc.), applied at 10.00% wpu.

The back was treated with a mixture of 7.50% sodium laurel sulfate surfactant (SCT610 available from Southern Chemical and Textiles), 30.00% Acrylic copolymer (composed of 65% methoacrylic acid and 35% ethyl acrylate), 3.78% Urethane dispersion (Arko Phob Dan from Clariant), 1.10% Anionic fluorosurfactant (Zonyl FSP available from DuPont de Nemours), and 3.00% Amide oxide surfactant (Mykon NRW3 available from Omnova Solutions Inc.), applied at 10.00% wpu.

Example A4

The fabric face was sanded.

0.5% fluoroalkyl acrylate (Unidyne TG992 available from Daiken Chemical) owf was added in dyeing.

The fabric face was treated with a mixture of 8.30% fluorochemical repellent (Repearl F8025 from MCI Specialty Chemicals), 25.00% fluoroalkyl acrylate copolymer (Unidyne TG992 from Daiken Chemical), 8.60% Urethane dispersion (Arko Phob Dan from Clariant), and 3.00% Amide oxide surfactant (Mykon NRW3 available from Omnova Solutions Inc.), applied at 10.00% wpu.

The fabric back was treated with a mixture of 7.50% sodium laurel sulfate surfactant (SCT610 available from Southern Chemical and Textiles), 30.00% Acrylic copolymer (composed of 65% methacrylic acid and 35% ethyl acrylate), 3.78% Urethane dispersion (Arko Phob Dan from Clariant), 1.10% Anionic fluorosurfactant (Zonyl FSP available from DuPont), and 3.00% Amide oxide surfactant (Mykon NRW3 available from Omnova Solutions), applied at 10.00% wpu.

Examples A5 & A6

The face only was sanded in A5, and the face and back were sanded in A6.

1.0% fluoroalkyl acrylate copolymer (Unidyne TG992 from Daiken Chemical) and 0.5% Lubril QCJ (available from Abco Chemicals) (both owf) were added in the jet during dyeing.

The fabric face was treated with a mixture of 8.3% fluoroacrylate copolymer emulsion (Repearl F8025 available from MCI Specialty Chemicals), 25% fluoroalkyl acrylate copolymer (Unidyne TG992 from Daiken Chemical), 8.6% urethane dispersion (Arko Phob Dan from Clariant), and 3% amide oxide surfactant (Mykon NRW3 available from Omnova Solutions Inc.) at 10% wpu.

No additional chemistry was applied to the fabric back.

Examples A7 & A8

The face only was sanded on A7, and the face and back were sanded in A8.

1.0% fluoroalkyl acrylate copolymer (Unidyne TG992 available from Daiken Chemical) owf was added in dyeing.

The fabric face was treated with a mixture of 5.00% Ionic booster (Kymene 450 available from Hercules Chemicals), 8.30% fluoroacrylate copolymer emulsion (Repearl F8025 from MCI Specialty Chemicals), 25.00% fluoroalkyl acrylate copolymer (Unidyne TG992 from Daiken Chemical), 8.60% urethane dispersion (Arko Phob Dan from Clariant), and 3.00% amide oxide surfactant (Mykon NRW3 available from Omnova Solutions) at 10.00% wpu.

The fabric back was treated with a mixture of 7.50% sodium laurel sulfate surfactant (SCT610 available from Southern Chemical and Textiles), 30.00% Acrylic copolymer (composed of 65% methacrylic acid and 35% ethyl acrylate), 3.78% urethane dispersion (Arko Phob Dan from Clariant), 1.10% anionic fluorosurfactant (Zonyl FSP available from DuPont de Nemours), and 3.00% amide oxide surfactant (Mykon NRW3 available from Omnova Solutions Inc.) at 10.00% wpu.

Examples A9 & A10

The face only was sanded on A9, and the face and back of A10 were sanded.

1.0% fluoroalkyl acrylate copolymer (Unidyne TG992 from Daiken Chemical) and 0.5% Lubril QCJ available from Abco Chemicals owf were added in the dye jet. The fabric face was treated with a mixture of 5.00% ionic booster (Kymene 450 available from Hercules Chemical), 8.30% fluoroacrylate copolymer emulsion (Repearl F8025 from MCI Specialty Chemicals), 25.00% fluoroalkyl acrylate copolymer (Unidyne TG992 from Daiken Chemical), 8.60% urethane dispersion (Arko Phob Dan available from Clariant), and 3.00% amide oxide surfactant (Mykon NRW3 available from Omnova Solutions Inc.) at 10.00% wpu.

The fabric back was treated with a mixture of 7.50% sodium laurel sulfate surfactant (SCT610 available from Southern Chemical and Textiles), 30.00% acrylic copolymer (composed of 65% methacrylic acid and 35% ethyl acrylate), 3.78% urethane dispersion (Arko Phob Dan from Clariant), 1.10% anionic fluorosurfactant (Zonyl FSP available from DuPont de Nemours), and 3.00% amide oxide surfactant (Mykon NRW3 available from Omnova Solutions Inc.) at 10.00% wpu.

Examples A11 & A12

Ex. A11 was sanded on the face only, and A12 was sanded on the face and the back.

1.0% fluoroalkyl acrylate copolymer (Unidyne TG992 available from Daiken Chemical) owf was added in the dye jet.

The fabric face was treated with a mixture of 5.00% ionic booster (Kymene 450 available from Hercules Chemical), 8.30% fluoroacrylate copolymer emulsion (Repearl F8025 available from MCI Specialty Chemicals), 25.00% fluoroalkyl acrylate copolymer (Unidyne TG992 from Daiken Chemical), 8.60% urethane dispersion (Arko Phob Dan from Clariant), and 3.00% amide oxide surfactant (Mykon NRW3 available from Omnova Solutions Inc.) at 10.00% wpu.

Examples A13 & A14

A13 was sanded on the face only, and A14 was sanded on the face and the back.

1.0% fluoroalkyl acrylate copolymer (Unidyne TG992 available from Daiken Chemical) owf was added in dyeing.

The fabric face was treated with a mixture of 5.00% ionic booster (Kymene 450 available from Hercules Chemicals), 8.30% fluoroacrylate copolymer emulsion (Repearl F8025 from MCI Specialty Chemicals), 25.00% fluoroalkyl acrylate copolymer (Unidyne TG992 from Daiken Chemical), 8.60% urethane dispersion (Arko Phob Dan from Clariant), and 3.00% amide oxide surfactant (Mykon NRW3 available from Omnova Solutions Inc.) at 10.00% wpu.

The fabric back was treated with a mixture of 7.50% sodium laurel sulfate surfactant (SCT610 available from Southern Chemical and Textiles), 30.00% acrylic copolymer (composed of 65% methacrylic acid and 35% ethyl acrylate), 3.78% urethane dispersion (Arko Phob Dan from Clariant), 1.10% Zonyl FS62 available from DuPont de Nemours, and 3.00% amide oxide surfactant (Mykon NRW3 available from Omnova Solutions Inc.) at 10.00% wpu.

Results Of Example A

| | A1 | A2 | A3 | A4 | A5 | A6 | A7 |
|---|---|---|---|---|---|---|---|
| | | | | Sanding | | | |
| | Face Only | Face & Back | Face & Back | Face Only | Face Only | Face & Back | Face Only |
| Water Repellency-As Received (AR) | 6 | 6 | 6 | 6 | 6 | 6 | 5 |
| Water Repellancy-5 Wash | 4 | 6 | 6 | 4 | 6 | 6 | 5 |
| Water Repellancy-10 Wash | 1 | 4 | 6 | 4 | 6 | 6 | 5 |
| Water Repellancy-20 Wash | 0 | 4 | 4 | 4 | 6 | 6 | 4 |
| Water Repellancy-30 Wash | N/A | 2 | 3 | N/A | 4 | 6 | 4 |
| Oil-AR | 6 | 6 | 6 | 5 | 6 | 6 | 6 |
| Oil Repellancy-5 Wash | 5 | 4 | 4 | 2 | 5 | 4 | 5 |

-continued

| | A1 | A2 | A3 | A4 Sanding | A5 | A6 | A7 |
|---|---|---|---|---|---|---|---|
| | Face Only | Face & Back | Face & Back | Face Only | Face Only | Face & Back | Face Only |
| Oil Repellancy-10 Wash | 4 | 2 | 3 | 1 | 5 | 4 | 3 |
| Oil Repellancy-20 Wash | 4 | 0 | 2 | 0 | 4 | 3 | 1 |
| Oil Repellancy-30 Wash | N/A | 0 | 1 | N/A | 2 | 2 | 1 |
| Stain Release-0/1, 0/2 Corn Oil | 4.0/4.5 | 4.0/4.5 | 3.0/3.5 | 3.5/4.0 | 4.0/4.0 | 4.0/4.5 | 4.0/4.0 |
| Stain Release-4/5, 4/6 Corn Oil | 4.0/4.5 | 4.0/4.5 | 2.0/3.5 | 4.0/4.0 | 4.0/4.5 | 4.0/4.5 | 4.0/4.0 |
| Stain Release-0/1, 0/2 Mineral Oil | 4.0/4.5 | 4.0/4.5 | 2.5/3.5 | 3.5/4.0 | 4.0/4.5 | 4.0/4.5 | 4.0/4.0 |
| Stain Release-4/5, 4/6 Mineral Oil | 4.0/4.5 | 3.5/4.0 | 2.0/3.5 | 4.0/4.0 | 4.0/4.5 | 4.0/4.5 | 4.0/4.0 |
| Drop Wicking on Back-A/R | 120.0 | 354 | 20 | 350 | >360 | 355 | 68 |
| Drop Wicking on Back-10 W | 93.0 | 68 | 31 | 20 | 45 | 3 | 5 |
| Drop Wicking on Back-20 W | 63.0 | 17 | 57 | 10 | 75 | 10 | 3 |
| Drop Wicking on Back-30 W | N/A | 14 | 12 | N/A | 90 | 40 | 3 |

Results of Example A cont'd

| | A8 | A9 | A10 | A11 Sanding | A12 | A13 | A14 |
|---|---|---|---|---|---|---|---|
| | Face & Back | Face Only | Face & Back | Face Only | Face & Back | Face Only | Face & Back |
| Water-AR | 5 | 5 | 5 | 4 | 4 | 4 | 4 |
| Water Repellancy-5 Wash | 5 | 5 | 5 | 4 | 4 | 4 | 4 |
| Water Repellancy-10 Wash | 4 | 4 | 4 | 4 | 4 | 4 | 4 |
| Water Repellancy-20 Wash | 4 | 4 | 4 | 3 | 4 | 4 | 4 |
| Water Repellancy-30 Wash | 4 | 4 | 4 | 3 | 4 | 4 | 4 |
| Oil-AR | 6 | 6 | 6 | 6 | 6 | 6 | 6 |
| Oil Repellancy-5 Wash | 4 | 4 | 2 | 4 | 2 | 2 | 1 |
| Oil Repellancy-10 Wash | 3 | 3 | 2 | 3 | 2 | 0 | 1 |
| Oil Repellancy-20 Wash | 1 | 1 | 1 | 2 | 1 | 0 | 0 |
| Oil Repellancy-30 Wash | 1 | 0 | 0 | 0 | 1 | 0 | 0 |
| Stain Release-0/1, 0/2 Corn Oil | 4.0/4.0 | 4.0/4.0 | 4.0/4.0 | 4.0/4.0 | 4.0/4.0 | 4.0/4.0 | 4.0/4.0 |
| Stain Release-4/5, 4/6 Corn Oil | 3.5/4.0 | 3.5/4.0 | 3.5/4.0 | 4.0/4.0 | 4.0/4.0 | 4.0/4.0 | 4.0/4.0 |
| Stain Release-0/1, 0/2 Mineral Oil | 4.0/4.0 | 4.0/4.0 | 4.0/4.0 | 4.0/4.0 | 4.0/4.0 | 4.0/4.0 | 4.0/4.0 |
| Stain Release-4/5, 4/6 Mineral Oil | 4.0/4.0 | 4.0/4.0 | 4.0/4.0 | 4.0/4.0 | 4.0/4.0 | 4.0/4.0 | 4.0/4.0 |
| Drop Wicking on Back-A/R | 45 | 55 | 25 | >360 | 90 | 40 | 28 |
| Drop Wicking on Back-10 Wash | 3 | 10 | 10 | 5 | 8 | 5 | 5 |
| Drop Wicking on Back-20 Wash | 3 | 10 | 10 | 5 | 8 | 5 | 5 |
| Drop Wicking on Back-30 Wash | 3 | 10 | 10 | 5 | 8 | 5 | 5 |

Example B

Example B used an 8 oz/sq yard 3×1 left hand twill fabric made from 65/35 polyester/cotton 14.0/1 Ne warp yarn and a 12.0/1 Ne filling yarn both open end. Chemistry applied using two-sided foaming, process referenced above. Samples dried in a tenter under conditions familiar to those skilled in the art. Sanforized according to standard practices of those normally skilled in the art. Then steam pressed and baked at 310° F. for ten (10) minutes.

Example B1

Face—The fabric face was treated with 4.67% Fluoroacrylate emulsion (Zonyl 7713 manufactured by DuPont de Nemours, and sold by Ciba Specialty Chemicals), 14.40% fluoroalkyl acrylate copolymer (Unidyne TG992 available from Daiken Chemical), 5.32% urethane dispersion (Arko Phob Dan from Clariant), 13.40% DMDHEU resin (Permafresh MFX available from Omnova Solutions Inc.), 3.14% magnesium chloride catalyst (Catalyst 531 available from Omnova Solutions Inc.), and 3% amide oxide surfactant (Mykon NRW3 Omnova Solutions Inc.), applied at 15% wet pick up (wpu).

Back—Nothing additional was added to the fabric back.

Example B2

Face—The fabric face was treated with 7% fluoroacrylate emulsion (Zonyl 7713 available from Ciba Specialty Chemicals), 21.6% fluoroalkyl acrylate copolymer (Unidyne TG99s available from Daiken Chemical), 8% urethane dispersion (Arko Phob Dan available from Clariant), 40% DMDHEU resin (Permafresh MFX available from Omnova Solutions Inc.), 10% magnesium chloride catalyst (Catalyst 531 available from Omnova Solutions Inc.), and 3% amide oxide surfactant (Mykon NRW3 available from Omnova Solutions Inc.) applied at 10% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 1.1% anionic fluorosurfactant (Zonyl FSP available from DuPont de Nemours), 4.6% amide oxide surfactarit (Mykon NRW3 available from Omnova Solutions Inc.), 3.8% urethane dispersion (Arko Phob Dan from Clariant) applied at 10% wpu.

Example B3

Face—The fabric face was treated with 4.67% Fluoroacrylate emulsion (Zonyl 7713 available from Ciba Specialty Chemicals), 14.40% fluoroalkyl acrylate copolymer (Unidyne TG992 available from Daiken Chemical), 5.32% urethane dispersion (Arko Phob Dan from Clariant), 26.8% DMDHEU resin (Permafresh MFX available from Omnova Solutions Inc.), 6.28% magnesium chloride catalyst (Catalyst 531 available from Omnova Solutions Inc.), 3% amide oxide surfactant (Mykon NRW3 available from Omnova Solutions Inc.) applied at 15% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 1.1% anionic fluorosurfactant (Zonyl FSP available from DuPont de Nemours), 4.6% amide oxide surfactant (Mykon NRW3 available from Omnova Solutions Inc.) applied at 10% wpu.

Example B4

Face—The fabric face was treated with 7% fluoroacrylate copolymer emulsion (Repearl F8025 from MCI Specialty Chemicals), 21.6% fluoroalkyl acrylate copolymer (Unidyne TG992 from Daiken Chemical), 8% urethane dispersion (Arko Phob Dan from Clariant), 40% DMDHEU resin (Permafresh MFX available from Omnova Solutions Inc.), 10% magnesium chloride catalyst (Catalyst 531 available from Omnova Solutions Inc.), 3% amide oxide surfactant (Mykon NRW3 available from Omnova Solutions Inc.) applied at 10% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 4.6% amide oxide surfactant (Mykon NRW3 available from Omnova Solutions Inc.), 3.8% urethane dispersion (Arko Phob Dan from Clariant) applied at 10% wpu.

Example B5

Face—The fabric face was treated with 7% fluoroacrylate emulsion (Zonyl 7713 available from Ciba Specialty Chemicals), 21.6% fluoroalkyl acrylate copolymer (Unidyne TG992 from Daiken Chemical), 8% urethane dispersion (Arko Phob Dan from Clariant), 40% DMDHEU resin (Permafresh MFX available from Omnova Solutions Inc.), 10% magnesium chloride catalyst (Catalyst 531 available from Omnova Solutions Inc.), 3% amide oxide surfactant (Mykon NRW3 available from Omnova Solutions Inc.) applied at 10% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 1.1% anionic fluorosurfactant (Zonyl FSP available from DuPont de Nemours), 4.6% amide oxide surfactant (Mykon NRW3 Omnova Solutions Inc.), 3.8% urethane dispersion (Arko Phob Dan from Clariant) applied at 10% wpu.

Results of Example B

| REPELLANCY/ | B | | | | |
|---|---|---|---|---|---|
| RELEASE | B1 | B2 | B3 | B4 | B5 |
| Water-AR | 6 | 5 | 4 | 6 | 4 |
| Water Repellancy-5 W | 6 | 4 | 4 | 4 | 4 |
| Water Repellancy-10 W | 6 | 4 | 4 | 3 | 4 |
| Water Repellancy-20 W | 4 | 2 | 4 | 1 | 2 |
| Water Repellancy-30 W | 1 | 2 | 4 | 1 | 2 |
| Oil-AR | 6 | 4 | 6 | 5 | 5 |
| Oil Repellancy-5 W | 6 | 2 | 5 | 3 | 2 |
| Oil Repellancy-10 W | 4 | 1 | 4 | 0 | 1 |
| Oil Repellancy-20 W | 2 | 0 | 3 | 0 | 0 |
| Oil Repellancy-30 W | 3 | 0 | 1 | 0 | 0 |
| Spray Rating-AR | 80 | 70 | 80 | 80 | 70 |
| Spray Rating-5 W | 80 | 50 | 70 | 80 | 70 |
| Spray Rating-10 W | 70 | 50 | 80 | 70 | 50 |
| Spray Rating-20 W | 70 | 50 | 70 | 70 | 50 |
| Spray Rating-30 W | 80 | 50 | 70 | 70 | 50 |
| Stain Release-0/1, 0/2 Corn Oil | 3.5/4.0 | 3.5/4.0 | 4.0/4.0 | 4.0/4.0 | 3.5/4.0 |
| Stain Release-4/5, 4/6 Corn Oil | 3.5/4.0 | 3.0/3.5 | 3.0/3.5 | 4.0/4.0 | 3.0/3.5 |
| Stain Release-8/9, 8/10 Corn Oil | 3.5/4.0 | 3.5/4.0 | 3.0/3.5 | 4.0/4.0 | 3.5/4.0 |

-continued

| REPELLANCY/ | B | | | | |
|---|---|---|---|---|---|
| RELEASE | B1 | B2 | B3 | B4 | B5 |
| Stain Release-0/1, 0/2 Mineral Oil | 3.5/4.0 | 3.5/4.0 | 3.5/4.0 | 4.0/4.0 | 3.5/4.0 |
| Stain Release-4/5, 4/6 Mineral Oil | 3.5/4.0 | 3.5/4.0 | 2.5/3.0 | 4.0/4.0 | 3.0/3.5 |
| Stain Release-8/9, 8/10 Mineral Oil | 3.5/4.0 | 3.0/3.5 | 3.0/3.5 | 3.0/4.0 | 3.5/4.0 |
| Wicking-AR | >200 | 7 | 31 | 10 | 10 |
| Wicking-10 W | 84 | 10 | 13 | 8 | 10 |
| Wicking-20 W | N/A | 20 | 21 | 10 | 20 |
| Wicking-30 W | N/A | 10 | 10 | 9 | 10 |

Example C 8.0 to 8.5 oz/yd$^2$ 65/35 polyester/cotton blend with 14.0/1 Ne open end warp yarns and a 12.0/1 Ne open end filling yarn. Chemistry applied using two-sided foamer described above. After chemistry was applied to the surfaces of the fabric the sample was dried at 300° F. for two (2) minutes in a laboratory oven then steam pressed and baked at 310° F. for ten (10) minutes.

Example C1

Face—The fabric face was treated with 7% fluoroacrylate emulsion (Zonyl 7713 available from Ciba Specialty Chemicals), 21.6% fluoroalkyl acrylate copolymer (Unidyne TG992 available from Daiken Chemical), 8% urethane dispersion (Arko Phob Dan from Clariant), 40% DMDHEU resin (Permafresh MFX available from Omnova Solutions Inc.), 10% magnesium chloride catalyst (Catalyst 531 available from Omnova Solutions Inc.), 3% amide oxide surfactant (Mykon NRW3 available from Omnova Solutions Inc.), applied at 10% wpu.

Back—The fabric back was treated with 2.5% sodium laurel sulfate surfactant (SCT610 available from Southern Chemical and Textiles), 20% acrylic copolymer (composed of 65% methacrylic acid and 35% ethyl acrylate), 0.75% anionic fluorosurfactant (Zonyl FSP available from DuPont de Nemours), 2.5% urethane dispersion (Arko Phob Dan from Clariant), 3% amide oxide surfactant (Mykon NRW3 available from Omnova Solutions Inc.), applied at 10% wpu.

Example C2

Face—The fabric face was treated with 20% fluoroacrylate copolymer emulsion (Repearl F8025 available from MCI specialty Chemicals), 3% fluoroalkyl acrylate copolymer (Unidyne TG992 from Daiken Chemical), 5% urethane dispersion (Arko Phob Dan from Clariant), 40% DMDHEU resin (Permafresh MFX available from Omnova Solutions Inc.), 10% magnesium chloride catalyst (Catalyst 531 available from Omnova Solutions Inc.), 3% amide oxide surfactant (Mykon NRW3 Omnova Solutions Inc.), applied at 10% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 3.8% urethane dispersion (Arko Phob Dan from Clariant), 4.6% amide oxide surfactant (Mykon NRW3 available from Omnova Solutions Inc.), applied at 10% wpu.

Example C3

Face—The fabric face was treated with 7% Repearl F7105 (available from MCI Specialty Chemicals, 21.6% fluoroalkyl acrylate copolymer (Unidyne TG992 from Daiken Chemical), 8% urethane dispersion (Arko Phob Dan from Clariant), 40% DMDHEU resin (Permafresh MFX available from Omnova Solutions Inc.), 10% magnesium chloride catalyst (Catalyst 531 available from Omnova Solutions Inc.), 3% amide oxide surfactant (Mykon NRW3 Omnova Solutions Inc.), applied at 10% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 3.8% urethane dispersion (Arko Phob Dan from Clariant), 4.6% amide oxide surfactant (Mykon NRW3 available from Omnova Solutions Inc.), applied at 10% wpu.

Example C4

Face—The fabric face was treated with 7% fluoroacrylate copolymer emulsion (Repearl F8025 available from MCI Specialty Chemicals), 21.6% fluoroalkyl acrylate copolymer (Unidyne TG992 available from Daiken Chemical), 8% urethane dispersion (Arko Phob Dan from Clariant), 40% DMDHEU resin (Permafresh MFX available from Omnova solutions Inc.), 10% magnesium chloride catalyst (Catalyst 531 available from Omnova Solutions Inc.), 3% amide oxide surfactant (Mykon NRW3 Omnova Solutions Inc.), applied at 10% wpu.

Back—The fabric back was treated with 7.5% sodium laurel sulfate surfactant (SCT610 available from Southern Chemical and Textiles), 30% acrylic copolymer (composed of 65% methacrylic acid and 35% ethyl acrylate), 3.8% urethane dispersion (Arko Phob Dan from Clariant), 4.6% amide oxide surfactant (Mykon NRW3 available from Omnova Solutions Inc.), applied at 10% wpu.

Results of Example C

| | C | | | |
|---|---|---|---|---|
| | C1 | C2 | C3 | C4 |
| Water-AR | 4 | 4 | 6 | 5 |
| Water Repellancy-5W | 4 | 4 | 6 | 5 |
| Water Repellancy-10W | 4 | 4 | 5 | 5 |
| Water Repellancy-20W | 4 | 4 | 5 | 4 |
| Water Repellancy-30W | 4 | 4 | 4 | 4 |
| Oil-AR | 6 | 5 | 6 | 6 |
| Oil Repellancy-5W | 5 | 4 | 4 | 5 |
| Oil Repellancy-10W | 2 | 2 | 3 | 3 |
| Oil Repellancy-20W | 1 | 2 | 2 | 2 |
| Oil Repellancy-30W | 1 | 1 | 1 | 2 |
| Stain Release-0/1, 0/2 Corn Oil | 3.5/4.0 | 3.5/4.0 | 4.0/4.0 | 4.0/4.0 |
| Stain Release-4/5, 4/6 Corn Oil | 3.5/4.0 | 3.0/3.5 | 4.0/4.0 | 4.0/4.0 |
| Stain Release-0/1, 0/2 Mineral Oil | 3.5/4.0 | 3.5/4.0 | 3.0/3.5 | 4.0/4.0 |
| Stain Release-4/5, 4/6 Mineral Oil | 3.5/4.0 | 3.0/3.5 | 3.0/3.5 | 3.0/3.5 |
| Drop Wicking on Back-A/R | 16 | 11 | 8 | 23 |
| Drop Wicking on Back-10W | 14 | 16 | 8 | 11 |
| Drop Wicking on Back-20W | 35 | | 10 | 12 |
| Drop Wicking on Back-30W | 12 | 23 | 16 | 35 |

Example D

3×1 left hand twill 8.0 to 8.5 oz/yd$^2$ 65/35 polyester cotton blend with the warp yarn being a 14.0/1 Ne and the filling yarn being a 12.0/1 Ne. Both the warp and filling are open end yarns.

Example D1 was Control Padded Both Sides

The fabric was treated with 1.16% Zonyl 7910 manufactured by Dupont de Nemours and sold by Ciba Specialty Chemicals, 13.86% Permafresh MFX available from Omnova Solutions, Inc., 3.47% Catalyst KR available from Omnova Solutions, Inc., 1.93% Mykon XLT available from Omnova Solutions, 0.39% Foamblock 1838 available from Bohme Filatex, and 0.27% Progasal DAP9 available from Abco Chemical applied at 40% wpu.

Example D2

The fabric was treated with 1.75% Zonyl 7713 manufactured by Dupont De Nemours and sold by Ciba Specialty Chemicals, 5.40% Repearl F8025 available from MCI Specialty Chemicals, 2% Arko Phob Dan available from Clariant Inc., 10% Permafresh MFX available from Omnova Solutions, Inc., 0.5% Mykon XLT available from Omnova Solutions, Inc. applied at 40% wpu.

Example D3

Face—The fabric face was treated with 7% fluoroacrylate emulsion (Zonyl 7713 available from Ciba Specialty Chemicals), 21.6% fluoroalkyl acrylate copolymer (Unidyne TG99s available from Daiken Chemical), 8% urethane dispersion (Arko Phob Dan available from Clariant), 40% DMDHEU resin (Permafresh MFX available from Omnova Solutions Inc.), 10% magnesium chloride catalyst (Catalyst 531 available from Omnova Solutions Inc.), and 3% amide oxide surfactant (Mykon NRW3 available from Omnova Solutions Inc.) applied at 10% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 1.1% anionic fluorosurfactant (Zonyl FSP available from DuPont de Nemours), 4.6% amide oxide surfactant (Mykon NRW3 available from Omnova Solutions Inc.), 3.8% urethane dispersion (Arko Phob Dan from Clariant) applied at 10% wpu.

Example D4

Face—The fabric face was treated with 4.67% Fluoroacrylate emulsion (Zonyl 7713 available from Ciba Specialty Chemicals), 14.40% fluoroalkyl acrylate copolymer (Unidyne TG992 available from Daiken Chemical), 5.32% urethane dispersion (Arko Phob Dan from Clariant), 26.8% DMDHEU resin (Permafresh MFX available from Omnova Solutions Inc.), 6.28% magnesium chloride catalyst (Catalyst 531 available from Omnova Solutions Inc.), 3% amide oxide surfactant (Mykon NRW3 available from Omnova Solutions Inc.) applied at 15% wpu.

Back—The fabric back was treated with 3.8% sodium laurel sulfate surfactant (SCT610 available from Southern Chemical and Textiles), 30% acrylic copolymer (composed of 65% methacrylic acid and 35% ethyl acrylate), 1.1% anionic fluorosurfactant (Zonyl FSP available from DuPont de Nemours), 4.6% amide oxide surfactant (Mykon NRW3 available from Omnova Solutions Inc.) applied at 10% wpu.

Example D Test Results

| Test | Ex. D1 | Ex. D2 | Ex. D3 | Ex. D4 |
|---|---|---|---|---|
| Air Permeability (cfm) | 22.90 | 24.60 | 20.70 | 15.30 |
| Water Vapor Transmission- face (weight loss/square meters) | 462.56 | 462.56 | 550.66 | 550.66 |
| Water Vapor Transmission- back (weight loss/square meters) | 462.56 | 440.53 | 528.63 | 484.58 |

Example E

Substrate is 100% polyester 2×2 right hand twill in the 6.0 to 6.5 oz/yd$^2$ weight range. The warp yarn is a 1/150/176 filament yarn and the filling is a 2/140/200 filament yarn.

After finishing the fabric was dried as normally for those skilled in the art.

Example E1

Has 1% Milease HPA manufactured by Clariant and 1.0% Lubril QCF manufactured by Abco Chemicals added during jet dyeing and no additional chemistry added during drying on the tenter frame.

Example E2

Has 7% Zonyl 7910 manufactured by Dupont de Nemours and sold by Ciba Specialty Chemicals. 4% Zonyl 7713 manufactured by Dupont de Nemours and sold by Ciba Specialty Chemicals. 2% Reactant 901 manufactured by Noveon Inc., and 1% Curite 5361 manufactured by Noveon Inc. applied at 50% wpu.

Example E3

Face—The fabric was finished with 5% Kuymene 450 available from Hercules Chemicals, 8.3% Repearl F8025 manufactured by MCI Specialty Chemicals, 25% Unidyne TG992 from Daiken Chemicals, 8.6% Arko Phob Dan from Clairant Inc. and 3% Mykon ARW3 applied at 10% wpu.

Back—The fabric was finished with 2.5% SCT610 available from Southern Chemical and Textiles, 3% Mykon NRW3 manufactured by Omnova Solutions, Inc., 1.1% Zonyl FSP manufactured by Dupont de Nemours, 30% acrylic copolymer with 65% methacrylic acid and 35% ethyl acrylate, 3.75% Arko Phob Dan manufactured by Clairant Inc. applied at 10% wpu.

Example E4

Face—The fabric was finished with 5% Kymene 450 available from Hercules Chemicals, 8.3% Repearl F8025 available from MCI Specialty Chemicals, 25% Unidyne TG992 from Daiken Chemical, 8.6% Arko Phob Dan from Clariant Inc., 3% Mykon NRW3 from Omnova Solutions Inc. applied at 10% wpu.

Back—No additional chemistry applied.

Example E Test Results

| Test | Ex. E1 | Ex. E2 | Ex. E3 | Ex. E4 |
|---|---|---|---|---|
| Air Permeability (cfm) | 9.30 | 17.30 | 7.10 | 5.97 |
| Water Vapor Transmission- face (weight loss/square meters) | 814.98 | 616.74 | 792.95 | 770.93 |
| Water Vapor Transmission- back (weight loss/square meters) | 600.79 | 660.79 | 770.93 | 748.90 |

In the specification there has been set forth a preferred embodiment of the invention, and although specific terms are employed, they are used in a generic and descriptive sense only and not for purpose of limitation, the scope of the invention being defined in the claims.

We claim:

1. A method of forming a dual function fabric comprising the steps of:

providing a fabric substrate having first and second surfaces;

contacting the first surface of the fabric substrate with a cationic chemical treatment for providing a first function to the first surface; and contacting the second surface with an anionic fluorosurfactant for providing a second function to the second surface, wherein the first and second functions are distinct from each other, wherein the cationic chemical treatment and the anionic fluorosurfactant are incompatible with each other, and wherein the cationic chemical treatment and the anionic fluorosurfactant are substantially isolated on the surfaces to which they were applied.

2. A method of forming a dual function fabric comprising the steps of:

providing a fabric substrate having first and second surfaces;

contacting the first surface of the fabric substrate with a first chemical treatment for providing a first function to the first surface; and contacting the second surface with a second chemical treatment for providing a second function to the second surface, wherein the first and second functions are distinct from each other, wherein the first and second chemical treatments are incompatible with each other, and wherein the first and second chemical treatments are substantially isolated on the surfaces to which they were applied, and wherein the steps of contacting the first surface with a first chemical treatment and the second surface with a second chemical treatment are performed substantially simultaneously.

3. A method of forming a dual function fabric comprising the steps of:

providing a fabric substrate having first and second surfaces;

contacting the first surface of the fabric substrate with a cationic chemical treatment; and contacting the second surface of the fabric substrate with an anionic fluorosurfactant, wherein the cationic chemical treatment and the anionic fluorosurfactant are incompatible, and wherein the anionic and cationic chemistries are positioned only on the surfaces to which they are applied and are not located on the opposite fabric surface.

4. The method of claim 3, wherein the steps of contacting the first surface with a cationic chemical treatment and the second surface with an anionic fluorosurfactant are performed substantially simultaneously.

5. The method of claim 3, wherein the cationic chemical treatment comprises a water repellent agent.

6. The method of claim 5, further comprising the step of pretreating the fabric substrate with a soil release fluorochemistry prior to treating the fabric with the cationic chemical treatment and the anionic fluorosurfactant.

7. The method of claim 3, wherein the cationic chemical treatment comprises a water repellent fluorochemical.

8. The method of claim 3, wherein the treated first surface exhibits oil repellency of at least about 2.0 after 30 home washes.

9. The method of claim 3, wherein the treated second surface exhibits moisture wicking of about 30 seconds or less when tested according to the Drop Wicking Test Method.

10. The method of claim 3, wherein the steps of applying the cationic chemical treatment and the anionic fluorosurfactant are conducted as a wet-on-wet process.

* * * * *